US008875838B1

(12) United States Patent
Yano et al.

(10) Patent No.: US 8,875,838 B1
(45) Date of Patent: Nov. 4, 2014

(54) ACOUSTIC AND ELASTIC FLATBAND FORMATION IN PHONONIC CRYSTALS:METHODS AND DEVICES FORMED THEREFROM

(71) Applicant: Toyota Motor Engineering & Manufacturing North America, Inc., Erlanger, KY (US)

(72) Inventors: Kazuhisa Yano, Ann Arbor, MI (US); Debasish Banerjee, Ann Arbor, MI (US); Songtao Wu, Ann Arbor, MI (US); Gaohua Zhu, Ann Arbor, MI (US); Nichlas Z. Swinteck, Cave Creek, AZ (US); Pierre A. Deymier, Tucson, AZ (US)

(73) Assignees: Toyota Motor Engineering & Manufacturing North America, Inc., Erlanger, KY (US); Arizona Board of Regents, on behalf of the University of Arizona, Tucson, AZ (US)

( * ) Notice: Subject to any disclaimer, the term of this patent is extended or adjusted under 35 U.S.C. 154(b) by 0 days.

(21) Appl. No.: 13/870,343

(22) Filed: Apr. 25, 2013

(51) Int. Cl.
*G10K 11/16* (2006.01)
*G10K 11/165* (2006.01)

(52) U.S. Cl.
CPC ..... *G10K 11/165* (2013.01); *G10K 11/16* (2013.01)
USPC ..... 181/286; 181/207

(58) Field of Classification Search
USPC ..... 181/175, 207, 210, 286
See application file for complete search history.

(56) References Cited

U.S. PATENT DOCUMENTS

| | | | | |
|---|---|---|---|---|
| 8,309,181 | B2 | 11/2012 | Ishizuka et al. | |
| 8,309,278 | B2 | 11/2012 | Yang et al. | |
| 2011/0100746 | A1* | 5/2011 | Berker et al. | 181/286 |
| 2011/0247893 | A1* | 10/2011 | Berker et al. | 181/286 |
| 2011/0309020 | A1* | 12/2011 | Rietman et al. | 210/652 |

* cited by examiner

*Primary Examiner* — Jeremy Luks
(74) *Attorney, Agent, or Firm* — Christopher G. Darrow; Young Basile Hanlon & MacFarlane, P.C.

(57) ABSTRACT

A phononic device is provided suitable for attenuating mechanical vibration, as well as acoustic vibration that propagate through a medium. Through the periodic inclusion of domains of a material in a matrix that vary in the ratio of the longitudinal speed of sound (CL) and the transverse speed of sound (CT) between the domains and the matrix of equal to or greater than 2.0 and 40, respectively; improved significant attenuation of vibration is achieved.

20 Claims, 6 Drawing Sheets

ACOUSTIC AND ELASTIC FLATBAND FORMATION IN PHONONIC CRYSTALS:METHODS AND DEVICES FORMED THEREFROM

The present disclosure is directed generally to phononic crystals (PCs), and more particularly to phononic metamaterials suitable for attenuating mechanical vibration, as well as acoustic vibration that propagate through a medium.

BACKGROUND

Phononic metamaterials enable the manipulation of both elastic and acoustic waves in different media, from attenuation (including absorption and reflection) to coupling, tunneling, negative refraction and focusing. In particular, the attenuation of vibrations, such as vector mechanical vibrations through a solid, or a scalar acoustic vibration in a medium, such as in air or water, is important technologically for applications where the presence of such vibrations affects the intended performance of the device or entity in question, such as, but not limited to, a vehicle. Another example of this is the attenuation of high frequency (>2 KHz) sound in acoustic hearing aids.

In general, acoustic materials can be categorized according to their effect upon sounds. A sound insulating material is an acoustic material which can intercept and reflect a sound wave which is propagating through a fluid medium such as air, as opposed to a solid material (in other words, an elastic wave). Sound insulators are typically materials which have a high surface density, for example bricks and concrete.

A sound absorbing material is typically an acoustic material which is porous such that an airborne sound wave can propagate into the material with the mechanical or vibrational energy of the sound wave being reduced by converting the energy into thermal energy due to friction within the material. Examples of sound absorbing materials include open cell foamed plastics, fiberglass, blankets and the like.

Likewise, vibration dampening materials are acoustic materials which can intercept a sound wave propagating through a solid material, as opposed to air. The mechanical or vibrational energy of the sound wave is reduced by converting the energy of the sound into thermal energy due to deformation of the dampening material. Vibration dampening materials are typically applied directly to the surface of the solid material. Examples of vibration dampening materials include rubber, plastic, bituminous or loaded Ethylene Vinyl Acetate (EVA) materials and the like.

Most studies on elastic PCs have focused on identifying an absolute and/or partial phononic band gaps, controlling the direction of propagation of longitudinal and transverse vibrations and attenuating the phase-relationship between acoustic signals. Others considered the role rigid body rotation (a consequence of Mie scattering) plays in modifying the bulk modes of propagation in the phononic structure. Rotary resonance modes can strongly interact with Bragg gaps to yield extremely wide absolute acoustic band gaps. A one-dimensional (1D), lumped model composed of finite-sized masses and mass-less springs can be further used to provide an understanding of the underlying physics behind rotary resonance in two-dimensional (2D), solid/solid PCs.

The continuum theory of elasticity was established by the Cosserat brothers, which accounted for the rotational degrees of freedom of individual elements in addition to the standard translational degrees of freedom used in classical elasticity theory. In the Cosserat model, each material element has six degrees of freedom—three for translation (in the xyz directions) and three for rotation (pitch, yaw, and roll). The theory introduces a couple-stress tensor (a component arising from the coupling of rotational and shear waves) that fulfills the same role for torques as the stress tensor of classical elasticity plays for forces. In an embodiment, Cosserat continuum elasticity theory can be used to predict that rotational degrees of freedom (e.g. rotational wave modes) can strongly modify the dispersion of shear waves. Characterization exists of rotational elastic waves in three-dimensional (3D) granular PCs—structures comprised of pre-compressed, regular arrangements of spherical elastic particles. In these, the Hertz-Mindlin contact model can be used to represent the connection between the elements of the PC.

In a related aspect, the body structures of vehicles are being engineered with increased stiffness in order to improve vehicle handling and the ability to withstand impact. As the stiffness of a vehicle body structure increases so too does the transmission of noise and vibration through the body structure. In order to minimize the transmission of vibration, sheets of vibration dampening material and/or sound dampening materials are typically placed in areas where vibrations and noise are most prevalent and likely to impact performance of the vehicle's components and their interaction with passengers. This approach has met with limited success and noise management remains an ever growing problem.

Thus, there remains a need for an improved sound and vibration dampening and attenuating materials that would be compatible increasing stiffness requirement associated with modern vehicles for example.

SUMMARY

Disclosed, in various embodiments, are metamaterials suitable for attenuating mechanical vibration, as well as acoustic vibration that propagate through a medium, for example air or metal components.

In one embodiment, a phononic metamaterial device is provided that includes an array or matrix of an elastomer composed of a dispersed phase of a plurality of periodically repeating unit cells of a thermoplastic resin forming a two-dimensional and/or three dimensional lattice, wherein the ratio of the longitudinal speed of sound ($C_L$) and the transverse speed of sound ($C_T$) between the thermoplastic resin and the elastomer resin is equal to or greater than about 2.0 and about 40.0, respectively.

In another embodiment, a process of attenuating an elastic and/or an acoustic band gap frequency in a phononic device is provided that includes providing a phononic device that includes a two-dimensional array or matrix of an elastomer formed of or composed of a dispersed phase of a plurality of periodically repeating unit cells or domains of a thermoplastic resin forming a two-dimensional lattice, wherein the ratio of the longitudinal speed of sound ($C_L$) and the transverse speed of sound ($C_T$) between the thermoplastic resin and the elastomer is equal to or greater than about 2.0 and about 40.0, respectively. The process also includes the step of controlling a filling fraction (ff) of the dispersed phase and a domain radius for the plurality of periodically repeating domains, wherein the filling fraction (ff) is configured to form an inscribed volume of the elastomer among adjacent domains of the plurality of periodically repeating domains to attenuate the elastic and/or the acoustic band gap's frequency. Through the variation of the fractional concentration of the dispersed phase and the matrix, the phononic transmission is controlled. The fractional concentration of the dispersed phase is controlled to form interstitial regions between the dispersed phase areas that are highly effective in attenuating the elastic and/or the acoustic band gap's frequency. A variety of dispersed phase domain shapes are detailed including cylinders and spheres.

In yet another embodiment, a process is provided of attenuating an elastic and/or an acoustic band gap's frequency in a phononic device that includes providing a phononic device that includes an array or matrix of an elastomer including a dispersed phase of a plurality of periodically repeating spherical unit cells or domains of a thermoplastic resin forming a three-dimensional lattice, wherein the ratio of the longitudinal speed of sound ($C_L$) and the transverse speed of sound ($C_T$) between the thermoplastic resin and the elastomer is equal to or greater than about 2.0 and about 40.0, respectively. The process also includes the step of controlling a filling fraction (ff) of the dispersed phase and a domain radius for the plurality of periodically repeating domains, wherein the filling fraction (ff) is configured to form an inscribed volume of the elastomer among adjacent domains of the plurality of periodically repeating domains to attenuate the elastic and/or the acoustic band gap's frequency. Through the variation of the fractional concentration of the dispersed phase and the sphere radius, the phononic transmission is controlled. The fractional concentration of the dispersed phase is inversely proportional to the sphere radius and is configured to form an inscribed volume of the elastomer among adjacent spheres of the thermoplastic resin. By placing the device in vibrational contact with a vehicle body vibration from a body structure is well attenuated.

These and other features of the phononic metamaterials and processes of attenuating band gap frequencies therein will become apparent from the following detailed description when read in conjunction with the figures and examples, which are exemplary, and not intended to limit the scope of the appended claims.

BRIEF DESCRIPTION OF THE DRAWINGS

For a better understanding of the metamaterials and processes of attenuating band gap frequencies, with regard to the embodiments thereof, reference is made to the accompanying examples and figures, in which.

DETAILED DESCRIPTION

Figure 1:
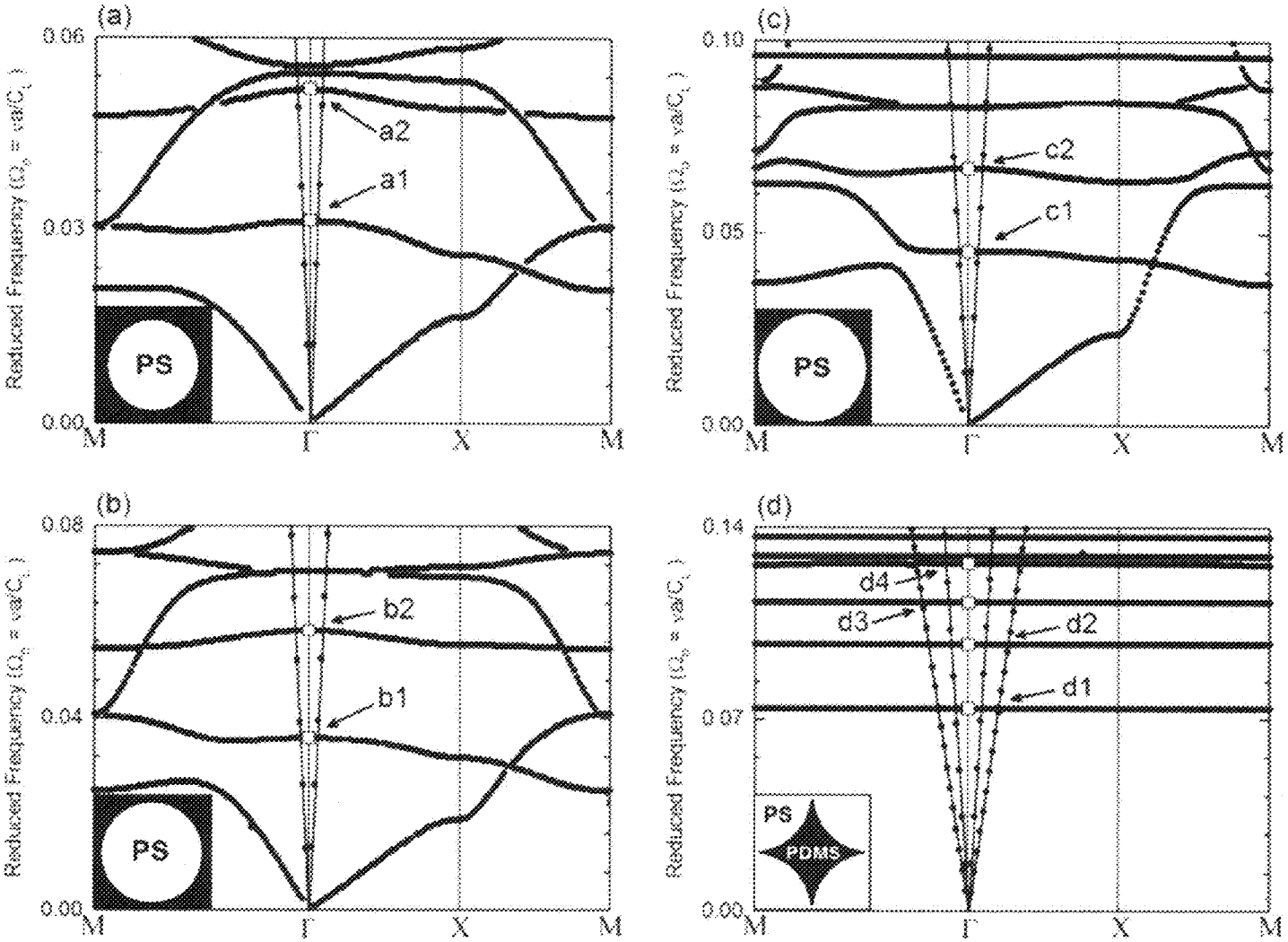
FIG. 1 is a graph showing Elastic band structure along high symmetry directions in the irreducible Brillouin zone of the PS/PDMS PC ((a) ff=0.5, (b) ff=0.6, (c) ff=0.7, (d) ff=0.8). In (d) the radius of the PS cylindrical rod is larger than half the lattice parameter of the PC. PS cylindrical rods from adjacent unit cells overlap to yield an isolated pocket of PDMS (see inset)

The present acoustic and elastic flatband formation in phononic crystals methods and apparatus has utility as a phononic device suitable for attenuation of mechanical vibration, as well as acoustic vibration shielding from sound propagating through a medium and processes of attenuating elastic and/or an acoustic band gap frequencies.

Composite inventive structures are formed of periodically arranged elastic scatterers of one material dispersed throughout a different homogeneous elastic matrix material can strongly affect the propagation of acoustic and elastic waves. These composite metamaterials (referring to materials that exhibit properties not found in nature), commonly referred to as phononic crystals (PCs), can be designed to show unique properties related to the manipulation/control of acoustic and elastic waves.

The existence of transverse vibrations in the structures necessitates the consideration of rotation for the spherical particles. Rotational degrees of freedom for the particles in the structure allow for individual rotational modes, as well as coupled rotary/translational modes in the dispersion relations.

In at least one particular embodiment, provided herein are 2D PC's composed of a unit cell of cylindrical polystyrene (PS) scatterers forming a dispersed phase, in a continuous phase matrix of poly(dimethylsiloxane) (PDMS) that exhibits distinct rotational resonance modes of its constitutive elements. These rotational waves are characterized with finite-difference time-domain (FDTD) calculations of elastic band structures and displacement fields. Calculations surprisingly show that the PS and PDMS components of the PC have unique, frequency-dependent rotary resonance modes that can be described by a one-dimensional analytical, discrete Cosserat lattice model. In the long wavelength limit, the PS/PDMS PC is elucidated as a physically realizable Cosserat continuum. In another embodiment, the phononic devices and processes of attenuating elastic and/or acoustic band gap frequencies disclosed herein make use of the fundamental properties of waves, such as scattering and interference, to create "band gaps"—ranges of wavelength or frequency within which waves cannot freely propagate through the structure. The band gap in a photonic crystal can be caused by a periodic variation in the refractive index of an artificially structured material. In a phononic crystal, the density and/or elastic constants of the structure change periodically. This changes the speed of sound in the crystal, which, in turn, leads to the formation of a phononic band gap.

In the long-wavelength limit, the PS/PDMS PC can support transverse rotational waves similar to those that are at the foundation of the rotational degrees of freedom in Cosserat continuum. These rotational degrees of freedom lead to effective asymmetric elastic coefficients on a homogenized PC. These phononic materials can offer unique opportunities in the design and control of acoustic properties of materials. For example, in acoustic transformation in solids, invariance can be achieved in very specific cases such as in materials with asymmetric stress tensor (i.e. asymmetric elastic0 coefficients). Therefore, the development of nanoscale elastomer-stiff polymer periodic structures such as the PS/PDMS PC can enable the development of novel effective media with uniquely attenuated acoustic characteristics. These phononic devices can serve subsequently as elastic or Cosserat-like elastic matrices in the fabrication of larger scale composite metamaterials Accordingly and in an embodiment, provided herein is a phononic metamaterial device including an array of an elastomer composed of a dispersed phase of a plurality of periodically repeating unit cells of a thermoplastic resin forming a two-dimensional and/or three dimensional impedance mismatched lattice with a matrix material, wherein the ratio of the longitudinal speed of sound ($C_L$) and the transverse speed of sound ($C_T$) between the thermoplastic resin and the elastomer resin is equal to or greater than about 2.0 and about 40.0, respectively. It is appreciated that an inventive phononic metamaterial is also readily formed by inverting the thermoplastic and elastomeric substances between matrix and dispersed domains to achieve the damping effects described herein.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

The term "elastomer", which may be used interchangeably herein with the term "rubber", refers to a polymer which can return to its initial dimensions when deformed by an external force. A polymer as used herein is considered an elastomer when the polymer or combination of polymers is/are consistent with the ASTM D1566 definition. ASTM D1566 is incorporated herein by reference in its entirety. Suitable elastomers for use herein can include thermoplastic elastomers with a Shore A hardness of 5-90 and a modulus of elasticity (Young's modulus) equal to or less than about 500 MPa, for example, equal to or less than about 100 MPa, specifically equal to or less than 10 MPa, or equal to or less than 1 MPa, more specifically, equal to or less than 0.9 MPa, or between about 0.3 and about 0.9 MPA. The elastomers can optionally be mixed with a suitable plasticiser or foaming agent to make them more compressible. Elastomers and/or rubbers operative herein illustratively include natural rubber, polyisoprene, styrene butadiene rubber, chloroprene rubber, polybutadiene, nitrile rubber, butyl rubber, ethylene propylene rubber, ethylene propylene diene rubber, chlorosulfonated polyethylene, polysulfide rubber, silicon-containing elastomer, polyurethane, and closed or open-cell foams thereof and/or any combination thereof. As used herein, the term "silicon-containing elastomer," is an elastomer which contains silicon. Examples of silicon-containing elastomers can be, polysiloxane, block copolymers containing segments of a polysiloxane and a polymer (e.g., poly(carbonate-siloxane), and silicon-modified elastomers. In an illustrated embodiment, the silicon-containing elastomer is polydimethylsiloxane (PDMS).

As used herein, the term "resin" refers to any organic resin known in the art suitable for use in the present disclosure. Resins may include, among others, thermosetting resins, thermoplastic resins, and polymeric resins. It is intended that a resin, as described herein, includes all suitable polymers, derivates, solvates, copolymers, and mixtures thereof. Polymers operative herein as the thermoplastic resin illustratively include poly(arylene ether)s, polystyrenes, unhydrogenated or hydrogenated block copolymers of an alkenyl aromatic compound and a conjugated diene, polyamides, polyimides, polyethers, polyetherimides, polyolefins, and polyesters. Also considered are polyphenylene ethers (PPE), a polyoxyphenylenes (POP), polysulphone, a polyaryl ether ketone (PEEK), a polycarbonate (PC), an acetal, a polyarylene sulfide or a copolymer of at least one of the foregoing.

In an embodiment, when the lattice formed is two dimensional (2D) with the periodically repeating unit cells containing for example, rods extend between at least two of the boundaries of a three dimensional elastomer matrix, the plurality of periodically repeating unit cells of the thermoplastic resin are cylindrical. The cylinders are readily formed with a cross-sectional shape of a circle, oval, or a polygon having n sides, where n is greater than or equal to 3, for example a square (n=4), a pentagon (n=5), a hexagon (n=6, etc) Likewise and in another embodiment, when the lattice formed by the periodically repeating unit cells is three dimensional (3D), the plurality of periodically repeating unit cells of the thermoplastic resin can be spherical or a three dimensional polyhedron. Representative polyhedral shapes for dispersed domains include tetrahedral, cuboidal, icosahedral, or a combination thereof. The three dimensional lattice thus formed in the phononic devices described herein, by the plurality of repeating unit cells, can be any combination having n sides wherein n is equal to or greater than 4, and formed interstitial voids of matrix material that can trap phononic frequencies. The dispersed domain are readily placed in a packing arrangement of, for example cubic close packed hexagonal, or orthorhombic packing with the proviso that adjacent dispersed domains avoid direct contact absent phononic transmission through matrix material.

The filling fraction (ff) (referring to the area fraction in the 2D primitive periodically repeating unit cell occupied by the dispersed phase), is inversely proportional to the radius of the thermoplastic, impedance mismatched cylinders or other domain shapes. The smaller the radius of an isolated domain forming the repeating unit cell, the greater is the filling fraction. For example, for a cylindrical rod having a diameter of 3.175 mm, ($1/8^{th}$ inch), the desired ff could be between 0.72 and 0.98 for a square lattice, while for a cylindrical rod having a diameter of 6.35 mm (0.25 inch), the desired ff can be between 0.67 to 0.90. In a particular embodiment, the lattice is a 2D square lattice of polystyrene (PS) dispersed in poly (dimethylsiloxane) (PDMS) at a filling fraction equal to or greater than 0.72. Similarly in the context of three dimensional lattice, the ff (referring to the volume fraction in the 3D periodically repeating unit cell that is occupied by the dispersed phase), is inversely proportional to the radius of the thermoplastic, impedance mismatched sphere.

In another embodiment, for a 2D PC metameterial as described herein, the filling fraction is configured to provide an inscribed area among adjacent circles representing the rods of the thermoplastic resin with mismatched impedance (see e.g., inset of FIG. 1*d*). It is understood, that in the metamaterial, the inscribed area represents a volume equal to the product of inscribed area and the length of the rod. Likewise, for a 3D PC metameterial as described herein, the filling fraction (ff) is configured to provide an inscribed volume among adjacent spheres.

In still another embodiment, the aforementioned phononic devices are used in the processes described herein to damp vibrations. The disclosed process of attenuating an elastic and/or an acoustic band gap's frequency in a phononic device, includes the provision of a phononic device having an elastomer matrix including a dispersed phase of a plurality of periodically repeating cylindrical domains of a thermoplastic resin forming a two-dimensional lattice to achieve a ratio of the longitudinal speed of sound ($C_L$) and the transverse speed of sound ($C_T$) between the thermoplastic resin domains and the elastomer is equal to or greater than 2.0 and 40.0, respectively. By varying the filling fraction (ff) of the dispersed phase and the cylindrical domain radius the elastic and/or the acoustic band gap's frequency is attenuated. It is of note that the filling fraction (ff) of the dispersed phase is inversely proportional to the cylindrical domain radius and is configured to form an inscribed volume of the elastomer among adjacent cylindrical rods of the thermoplastic resin.

In another embodiment, provided herein is a process of attenuating an elastic and/or an acoustic band gap's frequency in a phononic device is provided that includes the provision of a phononic device composed an elastomer matrix containing dispersed phase of a plurality of periodically repeating spherical or polyhedral domains of a thermoplastic resin forming a three-dimensional lattice, wherein the ratio of the longitudinal speed of sound ($C_L$) and the transverse speed of sound ($C_T$) between the thermoplastic resin and the elastomer is equal to or greater than about 2.0 and about 40, respectively. By varying the filling fraction (ff) of the dispersed phase and the domain radius the elastic and/or the acoustic band gap's frequency is attenuated.

As used herein, the term "attenuating" and its variants (e.g., "modulating"), refers to the process of engineering (in other words, increasing or decreasing by a measurable amount) the band gaps to appear in desired frequency bands of interest for "absorbing" and/or "shielding" and/or "reflecting" and/or "dampening" and/or "isolating" depending upon the context and should not be strictly construed to imply a single mechanism that produces the desired effect.

Young's modulus can impact elastic vibrations in lattices. Accordingly, an inventive process is facilitated by controlling the Young's modulus of the elastomer. Modifying the elastomer's Young's modulus can be done, for example, by cross-linking the elastomer. Cross linking agents useful for the purpose of the methods and devices described herein can be, for example, terminated poly(dimethylsiloxane) oligomers having degree of polymerization (n) of between about 5 and 20, for example, between about 5 and 15, or between 8 and 12. Others can be, for example, methyltrichlorosilane, trimethylsilyl-terminated poly(hydrogen methyl siloxane) or a cross linker combination comprising at least one of the foregoing.

The devices formed using the methods described herein, can be for example, an acoustic vibration dampening material, sound-absorbing material, a vibration-damping material, an acoustic mirror, a sealant, an insulator, a coupler, a film, a slab, a phononic thermocouple, a waveguide, or a phononic device including at least one of the aforementioned.

The phononic crystal devices described herein can be formed using a variety of conventional techniques illustratively including micromachining and optical lithographic techniques developed by the integrated circuits industry. In addition, by using electron beam and focused ion beam lithography, nano-scale phononic crystals can be fabricated. Likewise, phononic crystal devices as described herein, which are centered at room temperature can be formed by techniques such as ion implantation, diffusion and self-assembly.

In a particular embodiment, disclosed herein the vibrational properties of a 2D PC composed of a square lattice of PS cylindrical inclusions in a host matrix of PDMS is modeled using FDTD techniques. Calculated band structure show the existence of rotational waves. The existence of these waves can be permitted by the large contrast between the transverse speed of sound of the soft PDMS and that of the stiff PS. These rotational modes are characterized at the Gamma-point for the two lowest rotary bands. Moreover at the lowest frequency, a mode where the PDMS and PS regions undergo out-of-phase oscillatory rotations can be identified. The next lowest frequency exhibits in-phase oscillatory rotations of the PDMS and PS regions. A 1D discrete Cosserat lattice model is applied to analyze these modes. This lattice model can incorporate translational and rotational degrees of freedom. The latter can lead to rotary modes with finite frequencies at the Gamma (Γ)-point comparable to those observed in FDTD calculations.

In the long-wavelength limit, the PS/PDMS PC can support transverse rotational waves similar to those that are at the foundation of the rotational degrees of freedom in Cosserat continuum. These rotational degrees of freedom lead to effective asymmetric elastic coefficients on a homogenized PC. These phononic materials can offer unique opportunities in the design and control of acoustic properties of materials. For example, in acoustic transformation in solids, invariance can be achieved in very specific cases such as in materials with asymmetric stress tensor (i.e. asymmetric elastic coefficients). Therefore, the development of nanoscale elastomer-stiff polymer periodic structures such as the PS/PDMS PC can enable the development of novel effective media with uniquely attenuated acoustic characteristics. These phononic devices can serve subsequently as elastic or Cosserat-like elastic matrices in the fabrication of larger scale composite metamaterials.

The terms "a", "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the film(s) includes one or more films). Reference throughout the specification to "one embodiment", "another embodiment", "an embodiment", and so forth, when present, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

The phononic crystal devices and methods for attenuating the band gap's frequency in the phononic crystals described are further illustrated by the following non-limiting examples.

EXAMPLES

Example 1

FDTD Band Structures and Displacement Fields

The FDTD Model and Process

The PC of interest is composed of a square array of PS cylindrical rods embedded in a homogeneous, elastic matrix of PDMS. This combination of materials offers distinctive elastic band structures with modes corresponding to rotational waves. The elastic parameters for PS and PDMS used in FDTD calculations are listed as follows: ρ, PS=1050 kg/m3, $C_{L,PS}$=2350 m/s, $C_{T,PS}$=1200 m/s. ρ, PDMS=965 kg/m$^3$, $C_{L,PDMS}$=1076 m/s and $C_{T,PDMS}$ 27.6 m/s, where ρ, $C_L$ and $C_T$ denote density, longitudinal speed of sound and transverse speed of sound, respectively. Several PCs of different filling fraction (ff) are considered, where ff denotes the area fraction of PS in the 2D primitive unit cell for the PS/PDMS PC. The FDTD method is an effective means of generating band structures and displacement fields for the solid/solid composites considered herein.

In the FDTD method, a discrete simulation space comprised of a square grid of mesh points is constructed to describe the repeatable unit cell of the 2D PC. Each mesh point coincides with a density value and set of elastic parameter values ($C_{11}$, $C_{44}$ and $C_{12}$), where $C11=\rho C_L^2$, $C_{44}=\rho C_T^2$ and $C_{12}=C_{11}-2C_{44}$. The geometrical features of interfaces between different materials in the repeatable unit cell of the PC are well-resolved with FDTD grids composed of several hundred nodes in the x and y directions. The displacement of each grid point evolves in time according to the elastic wave equation. The dynamics of each node in the FDTD mesh are consistent with classical elasticity theory (e.g. grid points are considered to have only translational degrees freedom). The elastic wave equation is compatible with the discrete FDTD mesh when spatial and temporal derivatives are approximated with finite differences. Periodic boundary conditions are implemented to simulate a PC infinite in all spatial directions. These boundary conditions allow the elastic wave equation to be written in a form that satisfies Bloch's theorem. To render an elastic band structure with the FDTD method, a wave vector is first specified. For this wave vector, the initial condition imposed upon the FDTD grid is a delta function in displacement for a particular node in the mesh. This perturbation excites all normal modes of vibration within the infinite PC. From spatial derivatives, the divergence of the stress tensor is calculated which allows for the projection of the displacement field at the next step in time. Data for the temporal evolution of displacement for several different points in the FDTD mesh is stored for the entire length of the simulation. Applying a fast Fourier transform to this discrete data set reveals a spectrum where the peaks coincide with the eigenfrequencies for the specified wave vector. Performing this calculation for several different wave vectors along the high symmetry directions in the irreducible Brillouin zone of the PC produces the elastic band structure for the composite. FDTD simulations are run for $2^{21}$ time steps with discrete temporal step ($\Delta t=0.003a/C_{L,PDMS}$) and discrete spatial step $\Delta x=\Delta y=a/150$, where a is the lattice constant of the PC.

Results

FIG. 1 shows dispersion curves along high symmetry directions in the irreducible Brillouin zone for the PS/PDMS PC at four different ff values ((a) ff=0.5, (b) ff=0.6, (c) ff=0.7, (d) ff=0.8). For ff=0.8, the radius of the PS cylindrical rod is greater than half the lattice parameter of the PC. In this instance, a slight overlap between PS cylindrical rods from adjacent unit cells is allowed, effectively creating an isolated pocket of PDMS in PS (see inset of (d)). The vertical axis of all band structures in FIG. 1 is rendered in reduced frequency units where $\Omega_0=va/C_L$. Here, the $C_L$ value is that for PDMS (1076.5 m/s).

Figure 2:
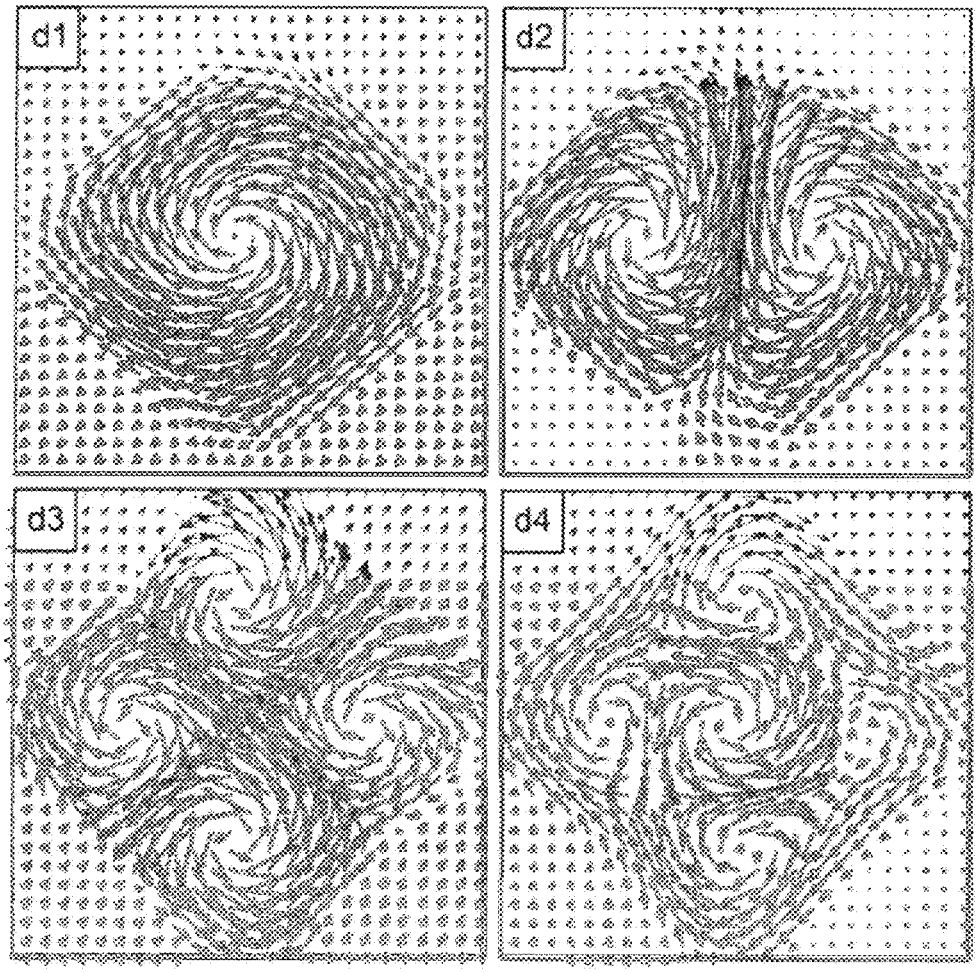
FIG. 2 is a graph showing FDTD displacement vector fields in xy-plane of modes d1, d2, d3 and d4 in FIG. 1*d* at a particular moment in time. Vibrations are isolated in the PDMS pocket. These modes are strictly related to shear vibrations.

In FIGS. 1*a*-1*d*, longitudinal and transverse bands are observed stemming from the Γ-point. As shown in FIGS. 1*a* through 1*c*, the slope of the longitudinal band is very large as compared to the transverse band. This demonstrates that the effective speed of sound for longitudinal vibrations is greater than that for transverse waves in the PS/PDMS PC. As shown in FIG. 1*d*, however, the host (in other words, the continuous) matrix material abruptly switches from PDMS to PS and the slope of the transverse band dramatically increases. FIG. 1*d* also shows the appearance of several flat bands. These flat bands are distinct and signify local modes of vibration in the PDMS pocket. The frequency of these resonances is dependent on the size of the PDMS pocket as well as the $C_T$ value of PDMS. The frequency of these flat bands is found to be an increasing function of 1/R, where R equals the radius of the largest circle one can inscribe inside the PDMS pocket, and a linear function of $C_{T,PDMS}$. Altering the $C_L$ value of the PDMS pocket was confirmed to not vary the position of these flat-band-modes in the dispersion diagram, making these resonances related to shear. FIG. 2 shows calculations of the displacement field in the FDTD grid at a particular snapshot in time for the first four flat bands in FIG. 1*d* (modes d1, d2, d3, d4 at the F-point).

Vector fields like this can be generated by perturbing the FDTD mesh with a point source oscillating at $\Omega_0$ (the frequency of interest) and integrating the equations of motion with a selected wave vector $k_0$ (the wave vector of interest). The displacement vector values of the nodes along the boundary between PDMS and PS are very small. If the PS material were allowed to freely rotate, as is the case when the PS cylindrical rods do not overlap (e.g., ff values 0.5, 0.6 and 0.7 in FIG. 1), then 'mixing' may occur between these local resonances and other modes of vibration (specifically shear modes). This concept is elucidated by identifying particular modes of vibration in FIGS. 1*a*, 1*b* and 1*c*.

Figure 3:
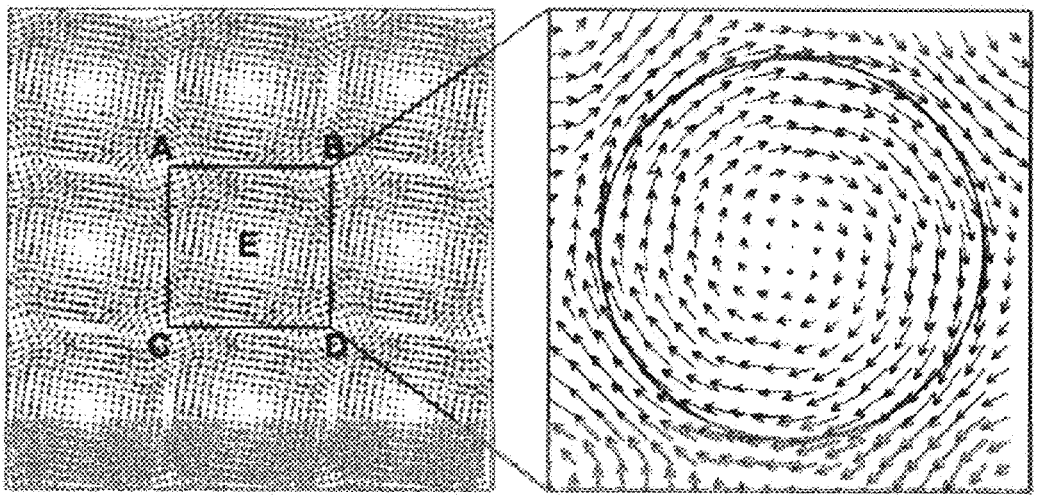
FIG. 3 is a graph showing rigid body rotation observed at point a1 in FIG. 1*a*. (left) FDTD displacement field calculation showing a super cell with nine periodically repeated PS cylindrical rods. (right) Enlarged image of central unit cell. Points A, B, C, D and E in the left hand plot mark centers about which material mass rotates. At this snapshot in time, material (PDMS) rotates in a anti-clockwise fashion about points A, B, C and D whereas at point E material (PS) rotates clockwise.
Figure 7:
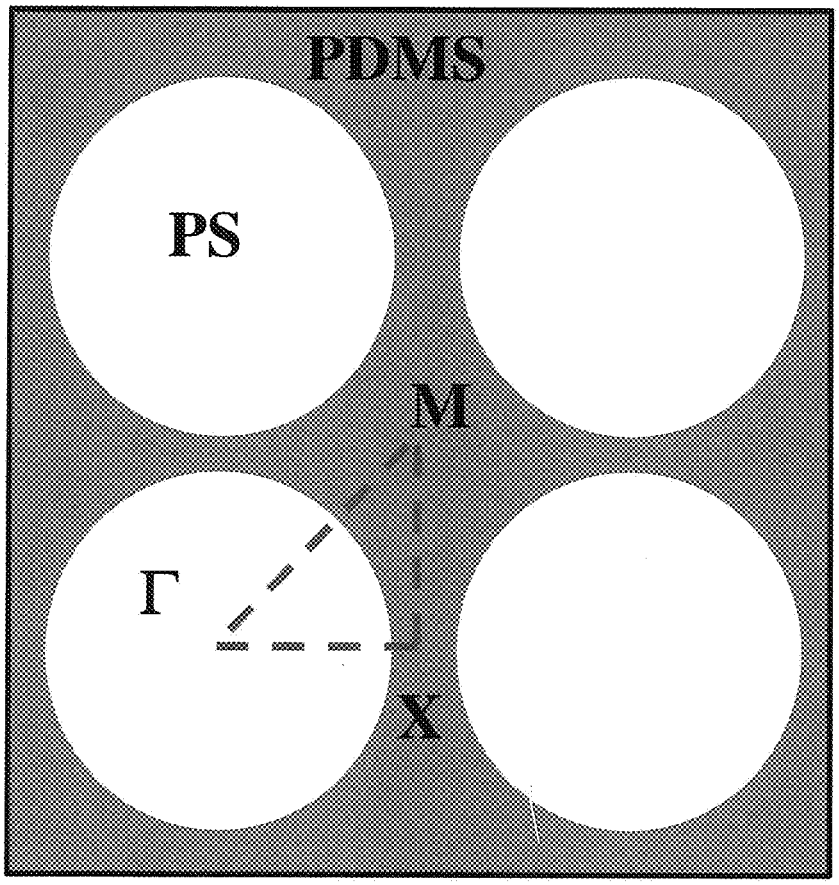
FIG. 7 shows the spatial parameters Γ, X and M used in FIG. 1.

In the following the transverse band from its origin at the Γ-point in FIGS. 1*a*, 1*b* and 1*c*, the first fold of this mode at the first Brillouin zone boundary (X-point, see e.g., FIG. 7) is identified. Modes a1, b1 and c1 at the Γ-point in FIGS. 1*a*, 1*b* and 1*c*, respectively, show rotation in the PDMS matrix as well as the PS inclusion. In FIG. 3, mode a1 is elucidated with a FDTD calculation of the displacement vector field in the primitive unit cell. Similar displacement fields are apparent for modes b1 and c1.

Figure 4:
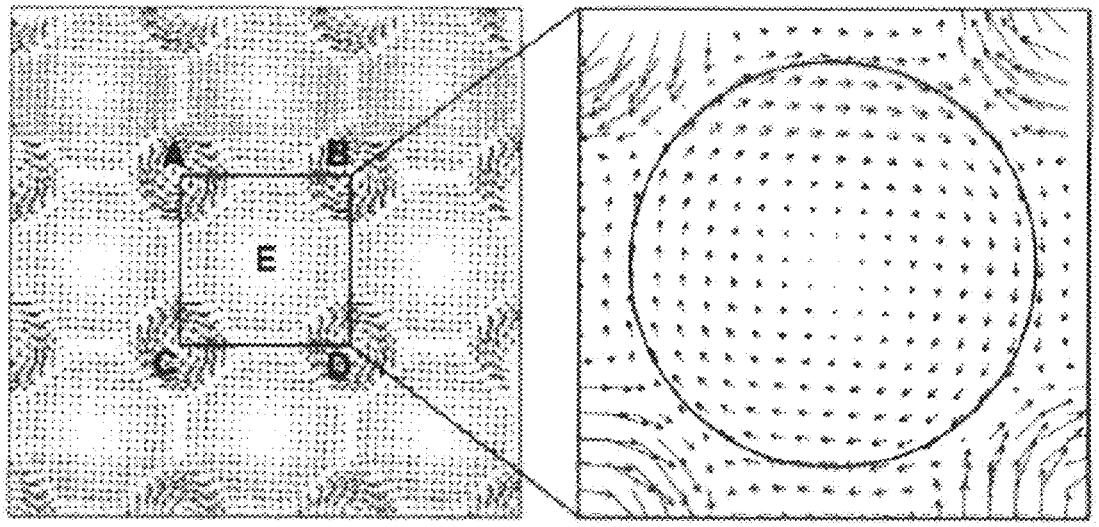
FIG. 4 is a graph showing rotary resonance mode at point a2 in FIG. 1*a*. (left) FDTD displacement field calculation showing a super cell with nine periodically repeated PS cylindrical rods. (right) Enlarged image of central unit cell. Points A, B, C, D and E in the left hand plot mark centers about which material mass rotates. At this snapshot in time, material (PDMS) rotates in a clockwise fashion about points A, B, C and D. At point E material (PS) rotates in the same direction.

The left hand figure of FIG. 3 shows a super cell comprised of nine PS cylindrical rods repeated periodically in space. The right hand of FIG. 3 shows an enlarged section of the left hand—the central unit cell. Points A, B, C, D and E in the left hand plot mark centers about which material mass rotates. For this snapshot in time, material (PDMS) rotates in an anti-clockwise fashion about points A, B, C and D whereas at point E material (PS) rotates clockwise. The oscillatory rotations observed in the PS and PDMS regions of the PC are phase-shifted by a value of π. FIG. 4 shows with FDTD the mode directly above a1 in FIG. 1*a* at the Γ-point (mode a2). Similar displacement fields are evident for modes b2 and c2 in FIGS. 1*b* and 1*c*, respectively. The left hand plot of FIG. 4 shows a super cell comprised of nine PS cylindrical rods repeated periodically in space. The right hand plot of FIG. 4 shows an enlarged portion of the left hand plot.

Points A, B, C, D and E in the left hand plot mark centers about which material mass rotates. The PDMS material were observed to rotate in a clockwise fashion about points A, B, C and D. Interestingly, at point E, the PS material rotates in the same direction. The oscillatory rotations observed in the PS and PDMS regions of the PC are in-phase. The origin of the rotations seen in FIGS. 3 and 4 is explained by implementing a simple model with a phenomenological foundation rooted in Cosserat elasticity theory.

Example 2

The Discrete Cosserat Lattice Model

Monoatomic and Diatomic Lattices

Figure 5:
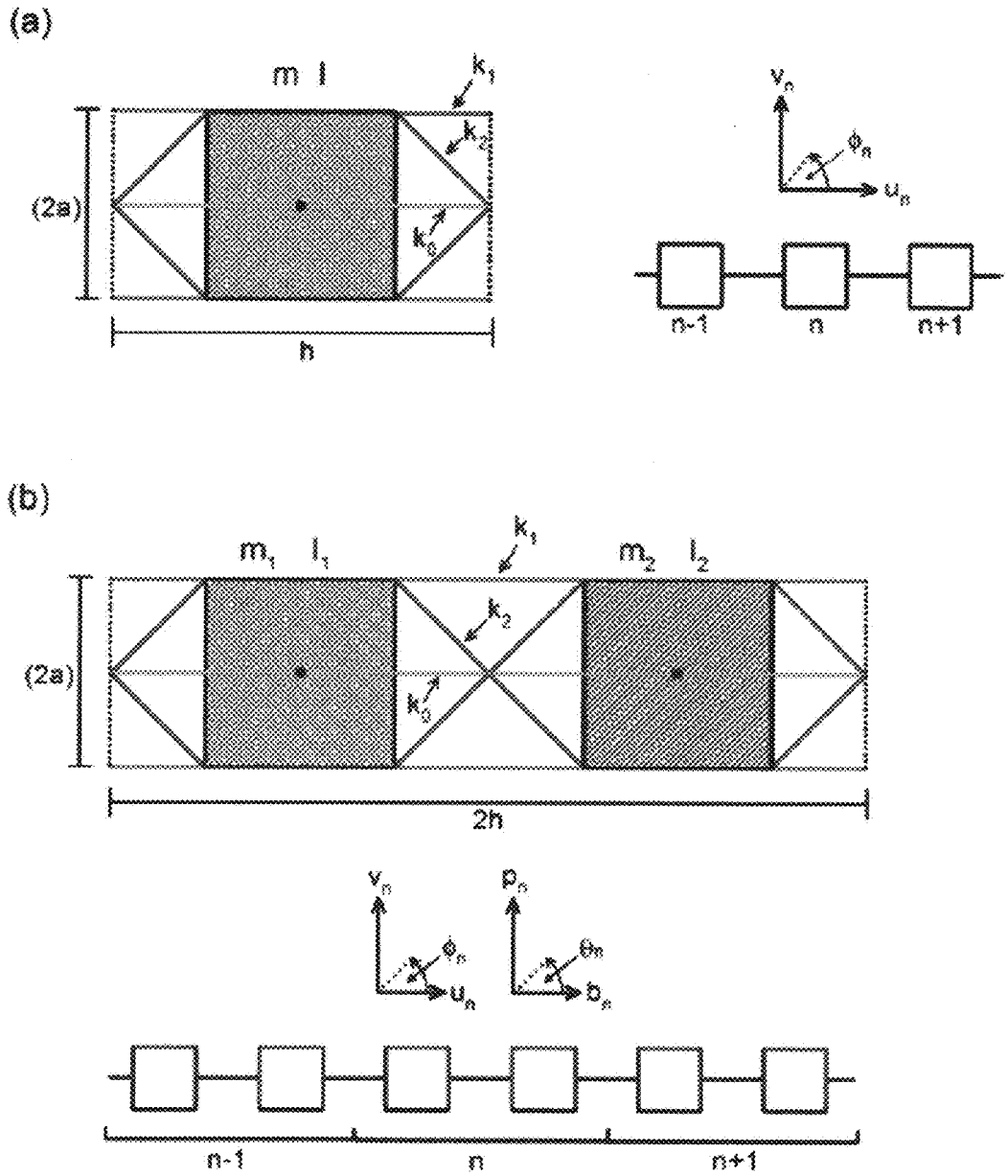
FIG. 5 is a graph showing (a) Cosserat model for monoatomic lattice. Each Cosserat element has mass (m) and moment of inertia (I). Elements are connected with springs of different stiffness and may freely move in the xy-plane as well as rotate about their center of mass. (b) Cosserat model for diatomic lattice with Cosserat elements 1 and 2.

A 1D discrete Cosserat lattice model was used, consisting of an infinite chain of square elements (Cosserat elements) connected with multiple, harmonic springs. Each element in the model is considered to have two translational degrees of freedom and one rotational degree of freedom (rotation about an axis perpendicular to the xy-plane). The left-hand side of FIG. 5*a* and the top part of FIG. 5*b* show the repeatable unit cells for the monoatomic and diatomic Cosserat lattice models, respectively. FIG. 5*a* shows periodicity (h) and FIG. 5*b* shows periodicity (2*h*).

Three different harmonic springs (spring constants $k_0$, $k_1$ and $k_2$) connect different parts of the Cosserat elements. The Cosserat element in FIG. 5*a* has mass (m) and moment of inertia (I). The Cosserat elements that make-up the diatomic unit cell have masses ($m_1$ and $m_2$) and inertial moments ($I_1$ and $I_2$). The right-hand side of FIG. 5*a* shows notation for the $n^{th}$ unit cell in the 1D monoatomic chain. The Cosserat element in the nth unit cell has x-displacement ($u_n$), y-displacement ($v_n$) and rotation component ($\phi_n$). $u_n$ and $v_n$ respectively represent displacements associated with longitudinal and transverse vibrations. The potential energy associated with the elastic connections of the Cosserat elements in unit cells (n) and (n+1) is written as follows:

$$E_{n,n+1} = \frac{1}{2}K_0(u_{n+1} - u_n)^2 + \frac{1}{2}K_1\left[(v_{n+1} - v_n) + \frac{1}{2}(\varphi_{n+1} + \varphi_n)\right]^2 + \frac{1}{2}K_2(\varphi_{n+1} - \varphi_n)^2 \tag{1}$$

where:

$$K_0 = \left(\frac{k_0}{h^2} + \frac{2k_1}{l^2} + \frac{2k_2 l^2}{l_d^4}\right),$$

$$K_1 = \left(\frac{2k_2(2a)^2}{l_d^4}\right),\ K_2 = \left(\frac{2a^2 k_1}{l^2}\right),\ l = h - (2a), \text{ and}$$

$$l_d = \sqrt{(l^2 + (2a)^2}\ .$$

Accordingly, the equations of motion for the Cosserat element in the nth unit cell of the monoatomic lattice are written as:

$$m\frac{d^2 u_n}{dt^2} = K_0(u_{n+1} - 2u_n + u_{n-1}) \tag{2}$$

$$m\frac{d^2 v_n}{dt^2} = K_1(v_{n+1} - 2v_n + v_{n-1}) + \frac{hk_1}{2}(\varphi_{n+1} - \varphi_{n-1}) \tag{3}$$

$$I\frac{d^2 \varphi_n}{dt^2} = K_2(\varphi_{n+1} - 2\varphi_n + \varphi_{n-1}) + \frac{hk_1}{2}(v_{n-1} - v_{n+1}) - \frac{h^2 k_1}{4}(\varphi_{n+1} + 2\varphi_n + \varphi_{n-1}) \tag{4}$$

Eq. (3) and Eq. (4) show coupling between transverse oscillations and elemental rotations in the monoatomic lattice and must be solved simultaneously. Solutions to these discrete equations of motion are considered to be of the form:

$$u_n(t)=u_0e^{i\omega t}e^{-iknh},\ v_n(t)=v_0e^{i\omega t}e^{-iknh},\ \phi_n(t)=\phi_0e^{i\omega t}e^{-iknh} \tag{5}$$

The $n^{th}$ unit cell in the diatomic lattice (bottom of FIG. 5*b*) contains two Cosserat elements. $u_n$ and $b_n$ represent displacements associated with longitudinal vibrations, $v_n$ and $p_n$ represent displacements linked with transverse vibrations and $\phi_n$ and $\theta_n$ represent rotations. The equations of motion for each Cosserat elements in the $n^{th}$ unit cell of the diatomic lattice can be found from extending Eqs. (2), (3) and (4) to the diatomic lattice configuration:

$$m_1\frac{d^2 u_n}{dt^2} = K_0(b_n - 2u_n + b_{n-1}) \tag{6}$$

$$m_1\frac{d^2 v_n}{dt^2} = K_1(p_n - 2v_n + p_{n-1}) + \frac{hk_1}{2}(\theta_n - \theta_{n-1}) \tag{7}$$

$$I_1\frac{d^2 \varphi_n}{dt^2} = K_2(\theta_n - 2\varphi_n + \theta_{n-1}) + \frac{hk_1}{2}(p_{n-1} - p_n) - \frac{h^2 k_1}{4}(\theta_n + 2\varphi_n + \theta_{n-1}) \tag{8}$$

$$m_2\frac{d^2 b_n}{dt^2} = K_0(u_{n+1} - 2b_n + u_n) \tag{9}$$

$$m_2\frac{d^2 p_n}{dt^2} = K_1(v_{n+1} - 2p_n + v_n) + \frac{hk_1}{2}(\varphi_{n+1} - \varphi_n) \tag{10}$$

$$I_2\frac{d^2 \theta_n}{dt^2} = K_2(\varphi_{n+1} - 2\theta_n + \varphi_n) + \frac{hk_1}{2}(v_n - v_{n+1}) - \frac{h^2 k_1}{4}(\varphi_{n+1} + 2\theta_n + \varphi_n) \tag{11}$$

Similar to the monoatomic case, the equations of motion for the diatomic case shows coupling between shear and rotary motions. Plane waves of similar form to those shown in Eq. (5) are assumed to resolve the dispersion curves for the diatomic lattice.

Results

Figure 6:
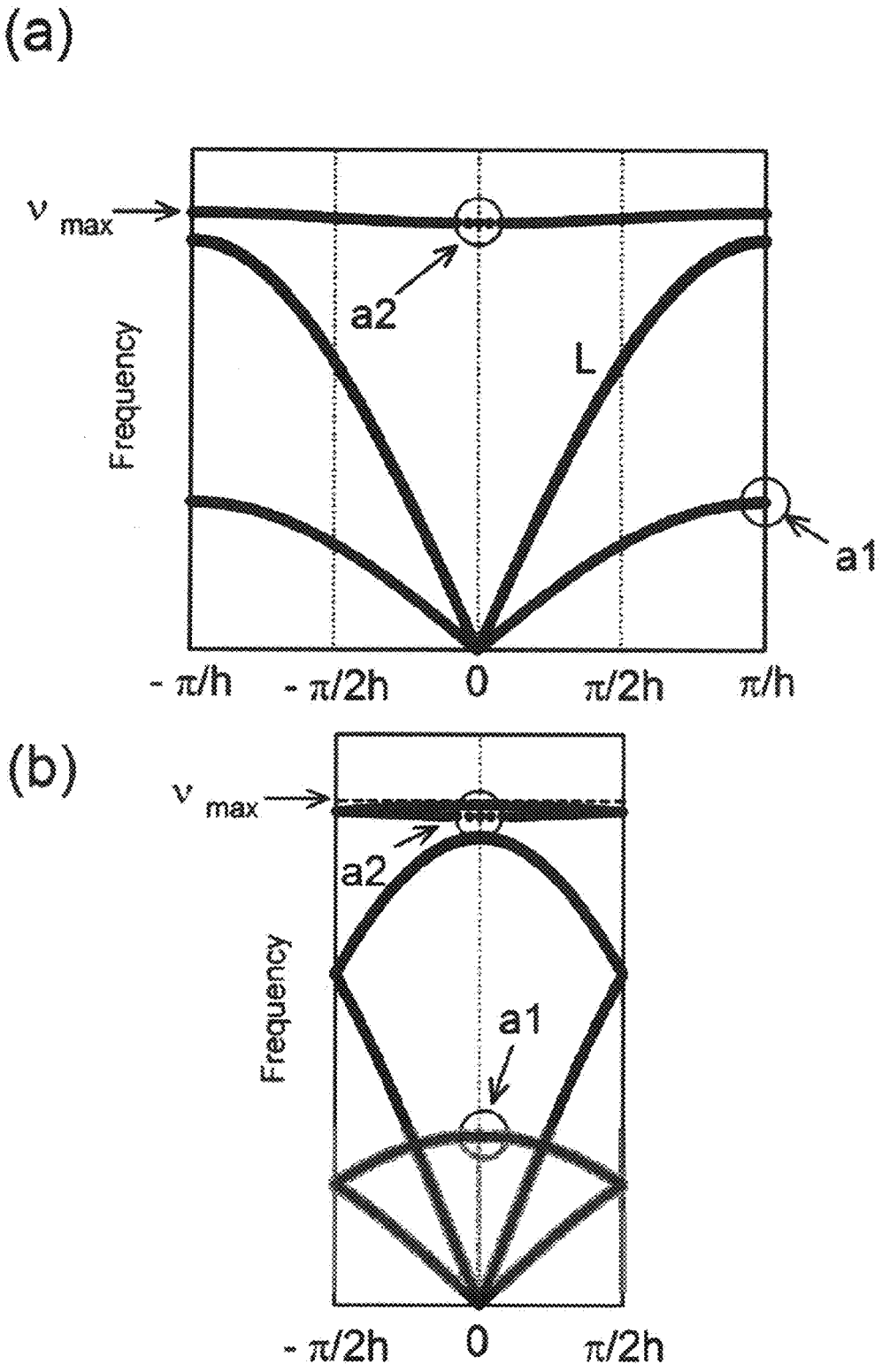
FIG. 6 is a graph showing (a) Dispersion diagram for monoatomic Cosserat lattice. (b) Dispersion diagram for diatomic Cosserat lattice. In (a) the band labeled with "L" is a purely longitudinal mode. The two other bands are mixed-modes that represent coupled transverse/rotational oscillations. In (b) the bands observed in (a) fold at the Brillouin zone boundaries of the diatomic lattice ((p/2h) and (−p/2h)). Modes a1 and a2 in (b) are equal to the modes a1 and a2 in (a). Modes a1 and a2 are representative of the oscillatory rotations presented in FIGS. 3 and 4, respectively, for the PS/PDMS PC.

The dispersion curve for the monoatomic Cosserat lattice is shown in FIG. 6*a*. Arbitrary values are selected for length parameters (a, h) as well as spring stiffness parameters $k_0$, $k_1$ and $k_2$.

Three bands are pictured in FIG. 6*a*. Two bands originate from the F-point at zero-frequency whereas a third starts from a finite-frequency value. The band labeled with "L" is the dispersion curve associated with Eq. (2). This is a purely longitudinal mode. The other bands are mixed modes representative of coupled transverse/rotational oscillations in the monoatomic lattice. Two modes (a1 and a2) are highlighted in FIG. 6*a*. Rotational-wave solutions are considered for these modes. For mode a1 (k=π/h) the time-dependent rotational wave solution is written as Eq. (12). For mode a2 (k=0) the solution for rotational waves is represented by Eq. (13):

$$\phi_n(t)=\phi_0 e^{i\omega t}e^{-in\pi} \tag{12}$$

$$\phi_n(t)=\phi_0 e^{i\omega t} \tag{13}$$

If one considers Eq. (12) and the Cosserat elements located in unit cells (n−1) and (n+1), then the following relationships can be written:

$$\phi_{n-1}(t)=\phi_0 e^{i\omega t}e^{-i(n-1)\pi}=\phi_0 e^{i\omega t}e^{in\pi}e^{i\pi}=\phi_n(t)e^{i\pi} \tag{14}$$

$$\phi_{n+1}(t)=\phi_0 e^{i\omega t}e^{-i(n+1)\pi}=\phi_0 e^{i\omega t}e^{in\pi}e^{-i\pi}=\phi_n(t)e^{i\pi} \tag{15}$$

Eq. (14) and (15) show a π-phase shift between the oscillatory rotation observed in unit cell (n) and the oscillatory rotations observed in the unit cells adjacent to (n), specifically unit cells (n−1) and (n+1). For a given Cosserat element and its nearest neighbor, mode a1 shows that they oscillate π-radians out-of-phase. If one considers Eq. (13) (mode a2) and the Cosserat elements neighboring unit cell (n) (elements in unit cells (n−1) and (n+1)), then it is apparent that all oscillations in the monoatomic chain are in-phase.

With knowledge of mode a1 and a2, we turn to the diatomic Cosserat lattice. If each Cosserat element in the repeatable unit cell for the diatomic lattice is made equivalent to that used in the monoatomic case above, then the resulting unit cell is a two-component-super cell. The band structure for this super cell is identical to taking FIG. 6*a* and folding the bands inward at the first Brillouin zone boundaries ((π/2h) and (−π/2h)) In doing so, mode a1 from FIG. 6*a* is moved such that it is now positioned at k=0 in FIG. 6*b*. Mode a2 from FIG. 6*a* stays in its same location. The band structure shown in FIG. 6*b* is a strong model for describing rotational waves along the ΓM-direction in FIG. 1*a*. Mode a1 of FIG. 6*b* is analogous to the oscillatory rotations observed for mode a1 of FIG. 1*a*. Mode a2 of FIG. 6*b* is analogous to the rotation observed for mode a2 of FIG. 1*a*.

In an embodiment, provided herein is a method of attenuating an elastic and/or an acoustic band gap's frequency in a phononic device, comprising: providing a phononic device comprising an array of an elastomer comprising a dispersed phase of a plurality of periodically repeating spherical unit cells of a thermoplastic resin forming a three-dimensional lattice, wherein the ratio of the longitudinal speed of sound ($C_L$) and the transverse speed of sound ($C_T$) between the thermoplastic resin and the elastomer is equal to or greater than about 2.0 and about 40 respectively; and varying the fractional concentration of the dispersed phase and the sphere's radius, wherein the fractional concentration of the dispersed phase is inversely proportional to the cylindrical rod radius and is configured to form an inscribed volume of the elastomer among adjacent spheres of the thermoplastic resin, thereby attenuating the elastic and/or the acoustic band gap's frequency, wherein (i) the lattice is two dimensional and the plurality of periodically repeating thermoplastic resin's unit cells forming the lattice are cylindrical (e.g., rods), (ii) the lattice is square and/or hexagonal, wherein (iii) the filling fraction (ff) of the dispersed phase is inversely proportional to the radius of the cylindrical rod, (iv) configured to yield an inscribed volume of the elastomer among adjacent cylindrical rods of the thermoplastic resin, wherein (v) the lattice is three dimensional and the plurality of periodically repeating thermoplastic resin's unit cells forming the lattice are spherical (vi) the lattice is cubic and/or a close hexagonal array, (vii) the filling fraction (ff) of the dispersed phase is inversely proportional to the radius of the sphere (viii) configured to yield an inscribed volume of the elastomer among adjacent spheres of the thermoplastic resin, wherein (ix) wherein the elastomer is natural rubber, polyisoprene, styrene butadiene rubber, chloroprene rubber, polybutadiene, nitrile rubber, butyl rubber, ethylene propylene rubber, ethylene propylene diene rubber, chlorosulfonated polyethylene, polysulfide rubber, silicon-containing elastomer, polyurethane, and closed or open-cell foams thereof and/or any combination thereof, (x) the thermoplastic resin is polyetherimides (PEI), a polyphenylene ether (PPE), a polyoxyphenylene (POP), a polysulphone, a polystyrene (PS), a polyaryl ether ketone (PEEK), a polycarbonate (PC), an acetal, a polyimide, a polyarylene sulfide or a copolymer comprising at least one of the foregoing, wherein (xi) the elastomer is poly(dimethylsiloxane) (PDMS) and the thermoplastic resin is poly(styrene) (PS), wherein (xii) the filling fraction (ff) of the dispersed phase is equal to or greater than 0.72, and (xiii) wherein the device is an acoustic vibration dampening material, sound-absorbing material, a vibration-damping material, an acoustic minor, a sealant, an insulator, a coupler, a film, a slab, a thermocouple, a waveguide, or a phononic device including at least one of the aforementioned.

In another embodiment, provided herein is a process of attenuating an elastic and/or an acoustic band gap's frequency in a phononic device including the provision of a phononic device composed of a matrix of an elastomer containing a dispersed phase of a plurality of periodically repeating cylindrical domains of a thermoplastic resin forming a two-dimensional lattice, wherein the ratio of the longitudinal speed of sound ($C_L$) and the transverse speed of sound ($C_T$) between the thermoplastic resin cylindrical domains and the elastomer is equal to or greater than 2.0 and 40.0, respectively. The two-dimensional lattice is square or hexagonal, (xv) the elastomer is natural rubber, polyisoprene, styrene butadiene rubber, chloroprene rubber, polybutadiene, nitrile rubber, butyl rubber, ethylene propylene rubber, ethylene propylene diene rubber, chlorosulfonated polyethylene, polysulfide rubber, silicon-containing elastomer, polyurethane, and closed or open-cell foams thereof and/or any combination thereof, (xvi) the thermoplastic resin is polyetherimides (PEI), a polyphenylene ether (PPE), a polyoxyphenylene (POP), a polysulphone, a polystyrene (PS), a polyaryl ether ketone (PEEK), a polycarbonate (PC), an acetal, a polyimide, a polyarylene sulfide or a copolymer comprising at least one of the aforementioned, (xvii) further comprising the step of modifying the elastic (Young's) modulus of the elastomer, wherein (xviii) the elastomer is poly(dimethylsiloxane) (PDMS) and the thermoplastic resin is poly(styrene) (PS), and (xix) the filling fraction (ff) of the dispersed phase is equal to or greater than 0.72.

In yet another embodiment, provided herein is a process of attenuating an elastic and/or an acoustic band gap's frequency in a phononic device includes the provision of a phononic device composed of an elastomer matrix containing a dispersed phase of a plurality of periodically repeating spherical or polyhedral domains of a thermoplastic resin forming a three-dimensional lattice, wherein the ratio of the longitudinal speed of sound ($C_L$) and the transverse speed of sound ($C_T$) between the thermoplastic resin and the elastomer is equal to or greater than 2.0 and 40, respectively. In this process, (xix) the three-dimensional lattice packing is cubic, a close packed hexagonal or orthorhombic, (xx) the elastomer is natural rubber, polyisoprene, styrene butadiene rubber, chloroprene rubber, polybutadiene, nitrile rubber, butyl rubber, ethylene propylene rubber, ethylene propylene diene rubber, chlorosulfonated polyethylene, polysulfide rubber, silicon-containing elastomer, polyurethane, and closed or open-cell foams thereof and/or any combination thereof, (xxi) the thermoplastic resin is polyetherimides (PEI), a polyphenylene ether (PPE), a polyoxyphenylene (POP), a polysulphone, a polystyrene (PS), a polyaryl ether ketone (PEEK), a polycarbonate (PC), an acetal, a polyimide, a polyarylene sulfide or a copolymer comprising at least one of the foregoing, (xxii) and in some embodiments entails modifying the elastic (Young's) modulus of the elastomer and (xxiii) the elastomer is poly(dimethylsiloxane) (PDMS) and the thermoplastic resin is poly(styrene) (PS).

While particular embodiments have been described, alternatives, modifications, variations, improvements, and substantial equivalents that are or may be presently unforeseen may arise to applicants or others skilled in the art. Accordingly, the appended claims as filed and as they may be amended, are intended to embrace all such alternatives, modifications variations, improvements, and substantial equivalents.

What is claimed:

1. A phononic metamaterial device comprising:

a matrix of an elastomer and a dispersed phase of a plurality of periodically repeating domains of a thermoplastic resin forming a two-dimensional or three dimensional lattice;

wherein a ratio of a longitudinal speed of sound in the thermoplastic resin to a longitudinal speed of sound in the elastomer is greater than or equal to 2.0, and wherein a ratio of a transverse speed of sound in the thermoplastic resin to a transverse speed of sound in the elastomer is greater than or equal to 40.0.

2. The device of claim 1, wherein the lattice is two-dimensional and the plurality of periodically repeating domains forming the lattice are cylindrical.

3. The device of claim 1 wherein the lattice is square or hexagonal.

4. The device of claim 1 wherein a filling fraction (ff) of the plurality of periodically repeating domains is inversely proportional to a radius of each of the plurality of periodically repeating domains.

5. The device of claim 4 wherein the filling fraction (ff) of the dispersed phase is configured to yield an inscribed volume of the elastomer among adjacent domains of the plurality of periodically repeating domains of the thermoplastic resin.

6. The device of claim 1 wherein the lattice is three-dimensional and the plurality of periodically repeating domains forming the lattice are spherical, wherein the periodically repeating domains each has a radius.

7. The device of claim 6 wherein the lattice is cubic, close packed hexagonal or orthorhombic.

8. The device of claim 7, wherein a filling fraction (if) of the dispersed phase is inversely proportional to the radius of each of the plurality of periodically repeating domains.

9. The device of claim 8 wherein the filling fraction (ff) of the dispersed phase is configured to yield an inscribed volume of the elastomer among adjacent domains of the plurality of periodically repeating domains.

10. The device of claim 1 wherein the elastomer is at least one of natural rubber, polyisoprene, styrene butadiene rubber, chloroprene rubber, polybutadiene, nitrile rubber, butyl rubber, ethylene propylene rubber, ethylene propylene diene rubber, chlorosulfonated polyethylene, polysulfide rubber, silicon-containing elastomer, polyurethane, a closed or open-cell foams thereof.

11. The device of claim 1 wherein the thermoplastic resin is at least one of polyetherimides (PEI), a polyphenylene ether (PPE), a polyoxyphenylene (POP), a polysulphone, a polystyrene (PS), a polyaryl ether ketone (PEEK), a polycarbonate (PC), an acetal, a polyimide, a polyarylene sulfide or a copolymer thereof.

12. The device of claim 1 wherein the elastomer is polydimethylsiloxane (PDMS) and the thermoplastic resin is polystyrene (PS).

13. The device of claim 12 wherein a filling fraction (ff) of the dispersed phase is equal to or greater than 0.72.

14. The device of claim 1 wherein:

the matrix of the elastomer and the disbursed phase of the plurality of periodically repeating domains of the thermoplastic resin form a plurality of unit cells supporting rotational waves of reduced frequency for acoustic attenuation.

15. A process of attenuating one of an elastic and an acoustic band gap frequency in a phononic device, comprising:

providing a phononic device comprising a matrix of an elastomer and a dispersed phase of a plurality of periodically repeating domains of a thermoplastic resin forming a two-dimensional or three dimensional lattice, wherein a ratio of a longitudinal speed of sound in the thermoplastic resin to a longitudinal speed of sound in the elastomer is greater than or equal to 2.0, and wherein a ratio of a transverse speed of sound in the thermoplastic resin to a transverse speed of sound in the elastomer is greater than or equal to 40.0 and controlling a filling fraction (ff) of the dispersed phase and a domain radius for the plurality of periodically repeating domains, wherein the filling fraction (ff) is configured to form an inscribed volume of the elastomer among adjacent domains of the plurality of periodically repeating domains to attenuate the elastic and/or the acoustic band gap's frequency.

16. The process of claim 15 further comprising the step of modifying the elastic (Young's) modulus of the elastomer.

17. The process of claim 16 wherein the filling fraction (ff) of the dispersed phase is equal to or greater than 0.72.

18. The process of claim 16 further comprising placing the device in vibrational contact with a vehicle body.

19. The process of claim 15 further comprising:

forming the domains as spherical or polyhedral domains of a thermoplastic resin.

20. The process of claim 15 further comprising:

forming a plurality of unit cells by the matrix of the elastomer and the disbursed phase of the plurality of periodically repeating domains of the thermoplastic resin to support rotational waves of reduced frequency for acoustic attenuation.

* * * * *